US005449276A

United States Patent [19]

Maruyama et al.

[11] Patent Number: 5,449,276

[45] Date of Patent: Sep. 12, 1995

[54] TWO STAGE VACUUM PUMP HAVING DIFFERENT DIAMETER INTERENGAGING ROTORS

[75] Inventors: Teruo Maruyama, Hirakata; Akira Takara, Higashiosaka, both of Japan

[73] Assignee: Matsushita Electric Industrial Co., Ltd., Osaka, Japan

[21] Appl. No.: 9,632

[22] Filed: Jan. 27, 1993

[30] Foreign Application Priority Data

Jan. 29, 1992 [JP] Japan ..... 4-13779

[51] Int. Cl.[6] ..... F04C 18/16; F04B 23/08

[52] U.S. Cl. ..... 417/205; 417/423.4; 418/2; 418/201.1

[58] Field of Search ..... 417/199.1, 199.2, 201, 417/205, 423.4, 423.5, 424.1; 418/2, 201.1; 74/DIG. 4, 424.7

[56] References Cited

U.S. PATENT DOCUMENTS

| | | | |
|---|---|---|---|
| Re. 17,689 | 6/1930 | Hibbard . | |
| 2,243,874 | 6/1941 | Lysholm . | |
| 2,640,428 | 6/1953 | Houghton . | |
| 3,639,087 | 2/1972 | Frohbieter . | |
| 3,811,805 | 5/1974 | Moody, Jr. et al. . | |
| 4,152,092 | 5/1979 | Swearingen . | |
| 4,420,291 | 12/1983 | Winstead . | |
| 4,625,156 | 11/1986 | Komiya et al. . | |
| 4,712,048 | 12/1987 | Rebsamen . | |
| 4,714,418 | 12/1987 | Matsubara et al. | 418/201.1 |
| 4,758,132 | 7/1988 | Hartwig . | |
| 4,770,615 | 8/1988 | Fujiwara et al. | 418/201.1 |
| 4,797,068 | 1/1989 | Hayakawa et al. | 417/201 |
| 4,808,077 | 2/1989 | Kan at al. . | |
| 4,829,217 | 5/1989 | Kameyama et al. . | |
| 4,850,806 | 7/1989 | Morgan et al. . | |
| 4,850,821 | 7/1989 | Sakai | 74/DIG. 4 |
| 4,913,634 | 4/1990 | Nagata et al. | 418/201.1 |
| 5,062,771 | 11/1992 | Satou et al. . | |
| 5,115,172 | 5/1992 | Ishii et al. . | |
| 5,118,251 | 6/1992 | Saulgeot | 417/205 |
| 5,166,566 | 11/1992 | Bernhardt et al. . | |
| 5,197,861 | 3/1993 | Maruyama | 417/205 |

FOREIGN PATENT DOCUMENTS

| | | | |
|---|---|---|---|
| 0221003 | 5/1987 | European Pat. Off. . | |
| 0256234 | 6/1987 | European Pat. Off. . | |
| 0230868 | 8/1987 | European Pat. Off. . | |
| 0340658 | 4/1989 | European Pat. Off. . | |
| 0382029 | 8/1990 | European Pat. Off. . | |
| 0435291 | 12/1990 | European Pat. Off. . | |
| 3153474 | 6/1973 | Germany . | |
| 3230550 | 1/1984 | Germany . | |
| 86951 | 7/1980 | Japan | 74/DIG. 4 |
| 60-259791 | 12/1985 | Japan | 418/201 |
| 62-314056 | 6/1989 | Japan | 418/201 |
| 182590 | 7/1989 | Japan | 418/201.1 |
| 809445 | 2/1959 | United Kingdom . | |
| 2123089 | 1/1984 | United Kingdom . | |
| 1551888 | 3/1990 | U.S.S.R. | 74/DIG. 4 |

OTHER PUBLICATIONS

"A Generalized Performance Computer Program for Oil Flooded Twin-Screw Compressor", Pawan J. Singh and Ghanshyam C., Patel, Ingersoll-Rand Research, Inc. Princeton, N.J., 1984, pp. 554–553.

"Computer Modeling For Performance Analysis of Rotary Screw Compressor": Mitsuru Fujiwara and Katsuhiko Kasuya, Mechanical Engineering Research Laboratory, Hitachi, Ltd., Ibaraki, Japan, 1984, pp. 536–543.

"A New Molecular Pump:", Louis Maurice, Proc. 6th Interl. Vacuum Congr. 1974 Japan, J. Appl. Phnys. Suppl. 2, Pt. 1, 1974.

Patent Abstracts of Japan "Multichannel Type Vacuum Pump", vol. 13, No. 225 (M-830) [357],, May 25, 1989.

*Primary Examiner*—Richard A. Bertsch

*Assistant Examiner*—Roland G. McAndrews, Jr.

*Attorney, Agent, or Firm*—Wenderoth, Lind & Ponack

[57] ABSTRACT

A fluid rotating apparatus includes a plurality of rotors accommodated in a housing, at least one of the rotors having its outer diameter different from that of the other of the rotors. Bearings are provided for supporting rotary shafts of the plurality of rotors. A fluid suction port and a fluid discharge port are formed in the housing. A motor is provides for rotating at least one of the plurality of rotors, and a control system for synchronously controlling the plurality of rotors in a contactless manner is provided for each rotary shaft of the plurality of rotors.

9 Claims, 10 Drawing Sheets

TWO STAGE VACUUM PUMP HAVING DIFFERENT DIAMETER INTERENGAGING ROTORS

BACKGROUND OF THE INVENTION

The present invention relates to a fluid rotating apparatus such as a vacuum pump, a compressor or the like.

A vacuum pump is inevitably necessary to produce a vacuum environment for a CVD device, a dry etching device, a sputtering device, an evaporation device, etc. in the manufacturing process of semiconductors. Meanwhile, as the manufacturing environment of semiconductors has been increasingly required to be clean and of a high-vacuum in recent years, a higher standard is set for the vacuum pump.

In order to obtain a high vacuum in a semiconductor plant, a vacuum discharge system composed of a roughing pump (positive displacement pump) and a high-vacuum pump (turbo molecular pump) is constituted. After a certain level of vacuum pressure is gained from atmospheric pressure by the roughing pump, the pump is switched to the high-vacuum pump to reach a predetermined level of vacuum pressure.

FIG. 8A shows a screw-type vacuum pump as one example of a conventional positive displacement pump (roughing pump), in which reference numeral 101 represents a housing; 102 represents a first rotary shaft; 103 represents a second rotary shaft; 104 and 105 represent cylindrical rotors supported by the respective rotary shafts 102 and 103; and 106 and 107 represent thread-type grooves in the outer peripheries of the respective rotors 104 and 105. In the conventional screw type vacuum pump, the first rotary shaft 102 and the second rotary shaft 103 are arranged parallel to each other within the housing 101, having rotors 104 and 105 thereon. The rotors 104 and 105 are provided with the thread grooves 106 and 107, respectively. When the recessed part (groove) of one rotor 106 or 107 is meshed with the projecting part (land) of the other rotor 107 or 106, a space is defined therebetween. As both rotors 104 and 105 are rotated, the volume of the space is changed to thereby draw and discharge air.

FIG. 8B shows a kind of a conventional kinetic vacuum pump (high-vacuum pump), i.e., a vacuum pump of a screw groove type having a turbine blade. In the drawing, reference numeral 201 represents a housing; 202 represents a cylindrical rotor; 203 represents a turbine blade; 204 represents a screw groove; 205*a* and 205*b* represent magnetic radial bearings which support a rotary shaft 207; and 206 represents a magnetic thrust bearing. The conventional vacuum pump with a turbine blade as shown in FIG. 8B has the rotor 202 inside the housing 201, and the turbine blade 203 and the screw groove 204 formed in the lateral upper and lower parts of the rotor 202. Each of the turbine blade 203 and the screw groove 204 impresses momentum to gas molecules, to cause suction and discharge.

The conventional vacuum pumps and the vacuum discharge system of a combination of the conventional vacuum pumps described hereinabove specifically have such drawbacks as follows.

(A) Drawbacks of roughing pump (positive displacement vacuum pump)

The synchronous rotation of the two rotors 104 and 105 is achieved by timing gears 110*a*, 110*b* in the screw type vacuum pump of FIG. 8A. That is, the rotation of a motor 108 is transmitted from a driving gear 109*a* to an intermediate gear 109*b*, and further to one timing gear 110*b* of the rotor 105 which is meshed with the timing gear 110*a* of the rotor 104. The phase of the rotating angle of each rotor 104, 105 is adjusted through the engagement of the timing gears 110*a* and 110*b*. Since the vacuum pump of this kind uses gears for the purpose of transmission of power from the motor and synchronous rotation of rotors, it is so designed that a lubricating oil 111 filled in a mechanical operating chamber where the gears are accommodated is supplied to the gears. At the same time, a mechanical seal 113 is provided between the mechanical operating chamber 111 and a fluid operating chamber 112 so as to prevent the lubricating oil from entering the chamber 112 where the rotors are housed.

In the above-described structure of the screw vacuum pump with two rotors, (1) many gears are needed for transmission of power and synchronous rotation of rotors, that is, a large number of components is used to thereby complicate the apparatus; (2) since the rotors are synchronously driven in a contacting manner by using gears, the apparatus is not able to operate at high speeds and becomes bulky; (3) due to abrasion, the mechanical seal is required to be regularly replaced and the apparatus is not completely maintenance-free; and (4) the large sliding torque resulting from the mechanical seal brings about a great mechanical loss.

(B) Drawbacks of high-vacuum pump (kinetic turbo molecular pump )

Similar to the roughing pump as described hereinabove, the turbo molecular pump is so constituted as to meet the requirement that the manufacturing environment of semiconductors should be clean. For instance, in the turbo molecular pump of a screw groove type having a turbine blade as shown in FIG. 8B, magnetic bearings 205*a*, 205*b*, 206 are employed in place of ball bearings utilizing oil lubrication. Therefore, the space where the bearings are accommodated is maintained as a vacuum in the turbo molecular pump. Although it is generally difficult to lubricate during the mechanical sliding motion in the vacuum, the above use of the magnetic bearings becomes a solution to this. Moreover, since an oil reservoir is not necessitated as in the structure using ball bearings, the apparatus can be mounted to a vacuum chamber in any posture. In contrast, each shaft should be provided with an electromagnet, a sensor, and a controller, which substantially increases costs in comparison with the structure of ball bearings.

(C) Drawbacks of vacuum discharge system

The conventional roughing pump (positive displacement vacuum pump) discharge air in the area of a viscous flow close to atmospheric pressure, and can obtain only a low degree of vacuum such as about $10^{-1}$ Pa. On the other hand, the convention high-vacuum pump (turbo molecular pump) is workable up to approximately $10^{-8}$ Pa or so, but is unable to discharge in the area of a viscous flow close to atmospheric pressure. As such, in the conventional arrangement, the roughing pump (e.g., the earlier-mentioned screw pump) is first used to create a vacuum of approximately $10^{0}-10^{-1}$ Pa, and subsequently the high-vacuum pump (kinetic turbo molecular pump) is used to attain a predetermined high degree of vacuum.

In the meantime, with the recent complication of the manufacturing process of semiconductors, a plurality of vacuum chambers have been independently driven, that is, a multi-chamber system has been the norm for use in manufacturing facilities. However, the above multi-chamber system requires the vacuum discharge system composed of a roughing pump and a high-vacuum pump for every chamber, thus causing the total system to be disadvantageously large-scale and complicated.

In order to solve the above-described drawbacks (a)–(c), there has been proposed an oil-free and compact vacuum pump, wherein each shaft of a plurality of rotors of a positive displacement vacuum pump is driven by an independent motor, while the rotors are synchronously rotated in anon-contacting manner. There has also been proposed a broad-band vacuum pump as well which is a complex pump having a kinetic vacuum pump formed coaxially above one shaft of a plurality of rotors of a positive displacement vacuum pump, thereby making it possible to create a high vacuum from atmospheric pressure by use of a single pump.

However, in order to obtain a higher discharge speed, it is necessary for the diameters of both rotors to be large so as to provide a large volume of space for discharging, but the control of the synchronous rotation of the rotors is complicated. While in order to maintain accurate control of the rotors, it is necessary for the diameters of the rotors to be small so as to get a quick response, but this causes the discharging speed to be low.

SUMMARY OF THE INVENTION

The present invention is a further improvement of the above proposals, and has for its object to provide a vacuum pump which, while maintaining the characteristics of the proposed vacuum pumps, i.e., cleanness, simple structure, compact size and the like, [1] further stabilizes the synchronous control of rotors with the pumping efficiency of the roughing pump kept unchanged, and [2] enhances the pumping efficiency of the broad-band vacuum pump in the high vacuum region to thereby reach a higher vacuum pressure.

In accomplishing these and other objects, according to one aspect of the present invention, there is provided a fluid rotating apparatus comprising: a plurality of rotors accommodated in a housing, at least one of the rotors having its outer diameter different from that of the other of the rotors; bearings for supporting rotary shafts of the plurality of rotors; a fluid suction port and a fluid discharge port formed in the housing; a motor for rotating at least one of the plurality of rotors; and means for synchronously controlling the plurality of rotors in a contactless manner that is provided for each rotary shaft of the plurality of rotors.

A screw type positive displacement pump is constituted, according to the present invention, of a combination of a plurality of rotors of different outer diameters, wherein the rotors are synchronously rotated without using transmission means such as timing gears, etc. which operate based on the mechanical contact therebetween as in the prior art. The rotor of smaller diameter is easy to speed up during the synchronous rotation for the following reasons:

<1> The mechanical natural frequency can be set high, so that the system never exceeds its dangerous speed even with a high rotating frequency; and <2> Since the absolute values of the load torque and the torque change resulting from the fluid pressure impressed to the rotors can be made small, the synchronous rotation is disturbed little.

Because of the fact that a shaft of the rotor of smaller diameter can be driven at high speeds as described hereinabove, if a kinetic pump is provided above the shaft of the rotor to thereby constitute a broad-band complex pump, the pumping speed in the high vacuum region can be advantageously increased and the ultimate degree of vacuum can be improved, or the like merits can be accomplished as the outer diameter of the high-vacuum pump is held small.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
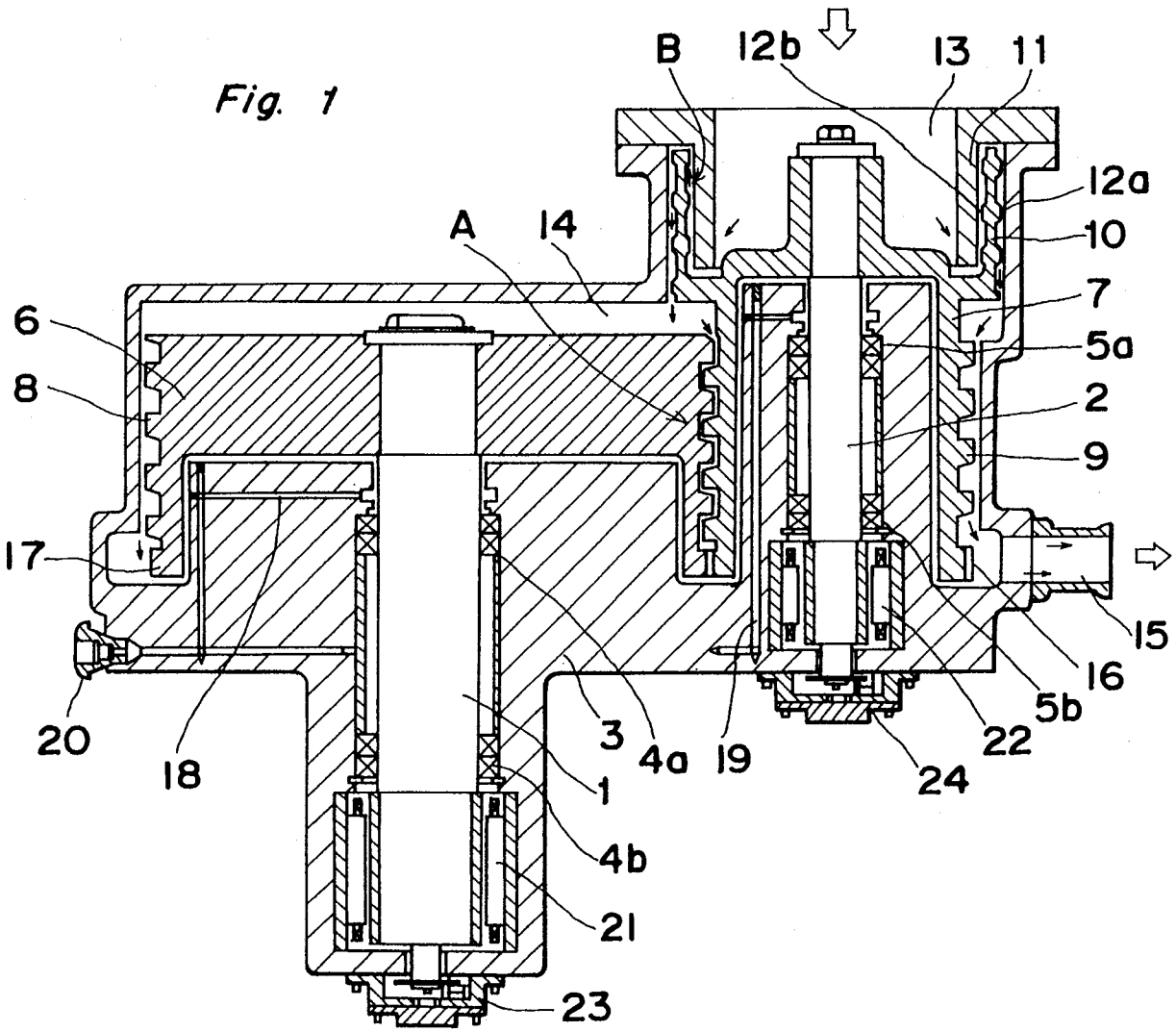
FIG. 1 is a cross-sectional view of a vacuum pump according to a first embodiment of the present invention.
Figure 2:
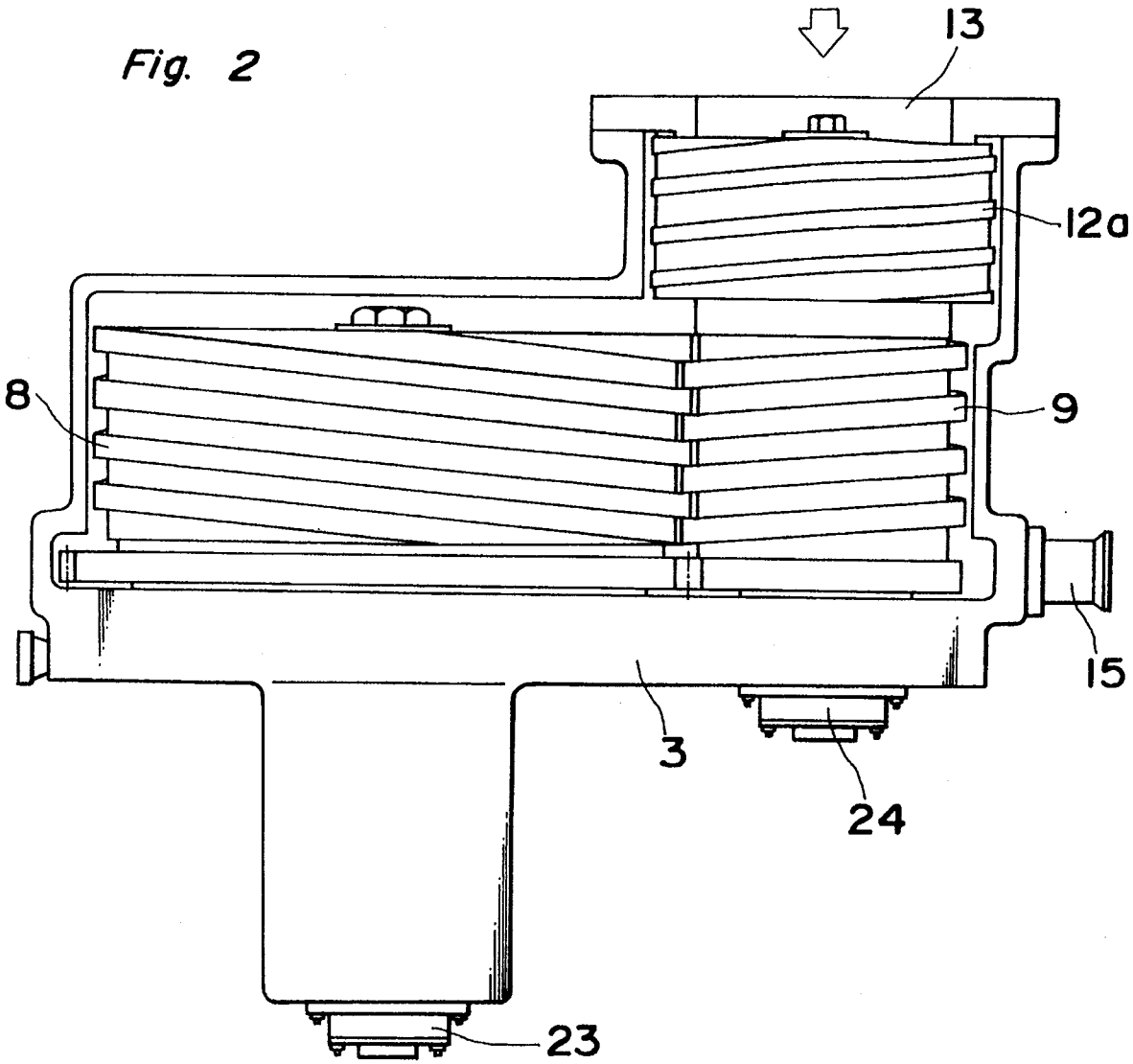
FIG. 2 is a side sectional view of the vacuum pump of FIG. 1 with a housing thereof partially removed.

FIGS. 1 and 2 illustrate a broad-band vacuum pump in one embodiment of a fluid rotating apparatus of the present invention. A first rotary shaft 1 and a second rotary shaft 2 are supported by bearings 4*a*, 4*b*, 5*a*, 5*b* accommodated in a housing 3. A cylindrical rotor 6 of large diameter and a cylindrical rotor 7 of small diameter are fitted with the first rotary shaft 1 and the second rotary shaft 2, respectively. There are screw grooves 8 and 9 formed to be meshed with each other in the outer peripheral surfaces of the corresponding rotors 6 and 7. A positive displacement vacuum pump structure section A is defined where the screw grooves 8 and 9 are meshed with each other. In other words, the volume of a space formed by the recessed part (groove) and the projecting part of the screw grooves 8 and 9, and the housing 3 is changed periodically as the rotary shafts 1 and 2 are rotated, and consequently the air is drawn and discharged.

Supposing that the outer diameter and the rotational frequency of the rotor 6 of large diameter are D and $\omega_0$, those of the rotor 7 of small diameter are D/2 and $2\omega_0$, respectively. The pumping amount of the pump according to the embodiment is equal to that of a screw pump of a combination of two rotors of the same diameter, because the rotor 7 makes two rounds as the rotor 6 rotates once. It is to be noted here that the closing volume of a rotor is proportional to the outer diameter thereof.

A sleeve-like upper rotor 10 is provided integrally with the cylindrical rotor 7 at the upper part of the second rotary shaft 2. The upper rotor 10 is accommodated in a rotatable manner in a clearance formed between the housing 3 and a fixed sleeve 11, with holding a narrow gap from the housing 3 and the fixed sleeve 11. Moreover, the upper rotor 10 has screw grooves 12*a* and 12*b* in the outer and inner peripheral surfaces thereof. The upper rotor 10, the screw grooves 12*a* and 12*b*, and the fixed sleeve 11 constitute a kinetic vacuum pump structure section B. The upper rotor 10 rotates with twice the rotational frequency of the rotor 6 of the positive displacement vacuum pump structure section A. A gas entering from a suction port 13 is discharged to a space 14 where the screw-type positive displacement pump structure section A is housed because of the drag function of molecules by the screw grooves 12*a* and 12*b*. The gas sent into the positive displacement pump structure section A is then discharged from a discharge port 15. This discharge port 15 may be positioned on the discharge side of the rotor 6.

Figure 3:
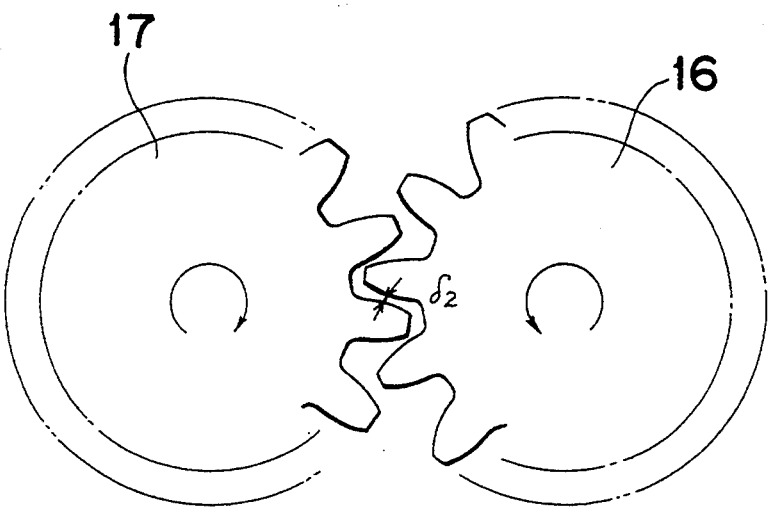
FIG. 3 is a plan view of contact preventing gears used in the first embodiment.

The rotors 6 and 7 are respectively provided with gears 16 and 17 of FIG. 3 in the outer peripheral surfaces at the lower ends thereof so as to prevent contact between the screw grooves 8 and 9. A solid lubricating film is formed in each contact preventing gear 16 and 17 to resist some metallic contact. A backlash gap $\delta_2$ formed when the gears 16 and 17 are meshed with each other is set to be smaller than a backlash gap $\delta_1$ (not shown) between the engaging screw grooves 8 and 9 in the outer peripheral surfaces of the rotors 6 and 7. Therefore, when the rotary shafts 1 and 2 are smoothly rotated synchronously, the contact preventing gears 16 and 17 do not contact one another. If the synchronous rotation is broken, however, the contact preventing gears 16 and 17 come into contact with each other before the screw groove 8 touches the screw groove 9, thereby preventing collision of the screw grooves 8 and 9. In this case, if the backlash gaps $\delta_1$ and $\delta_2$ are very small, it is feared that a practical level of accuracy will not be sufficient for processing the composing members. However, since the total amount of the fluid which leaks during one stroke of the pump is proportional to the time necessary for one stroke of the pump, if the rotary shafts 1 and 2 are rotated at high speeds, the performance of the vacuum pump (ultimate vacuum degree, etc.) can be maintained even if the backlash gap $\delta_1$ between the screw grooves 8 and 9 is set slightly larger. Therefore, it is possible to secure the backlash gaps $\delta_1$ and $\delta_2$ of the size necessary to prevent the collision of the screw grooves 8 and 9 with normal processing accuracy, because the rotary shafts 1 and 2 can be rotated at high speeds in the vacuum pump of the embodiment.

In the instant embodiment, a ball bearing is used for a bearing part, together with lubricating grease. At the same time, the invasion of the grease into a fluid operating chamber is prevented by a gas purge mechanism with the utilization of clean nitrogen gas of high pressure which is generally provided in semiconductor facilities, etc. In FIG. 1, reference numerals 18 and 19 indicate feed paths of the aforementioned nitrogen gas, and 20 is a feed joint of the housing 3.

Figure 5:
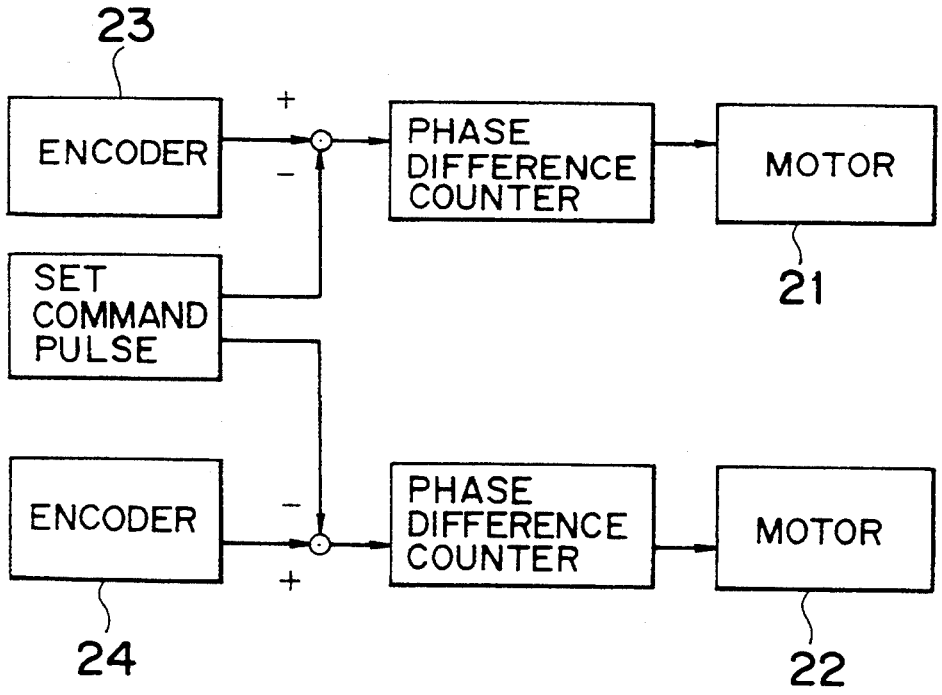
FIG. 5 is a block diagram of a synchronous control arrangement of the first embodiment.

While the ratio of the rotational frequency of the rotors 6 and 7 determined by the outer diameter ratio thereof is kept constant, the rotors 6 and 7 are rotated at high speeds of several tens of thousands of rpm by AC servo motors 21 and 22 independently provided at the lower parts of the rotary shafts 1 and 2, respectively. The PLL synchronous control of the two rotary shafts 1 and 2 in the instant embodiment is achieved according to a method shown in a block diagram of FIG. 5. That is, the output pulses outputted as signals from rotary encoders 23 and 24 which are located at the lower ends of the respective rotary shafts 1 and 2 as shown in FIG. 1 are compared with a set command pulse (target value) set for a virtual rotor. The deviation of the output value (rotational frequency, rotational angle) of each of the shaft 1 and 2 from the target value is operated by each phase difference counter, and the rotation of each of the servo motors 21 and 22 of each shaft 1, 2 is controlled to erase the deviation.

Figure 4:
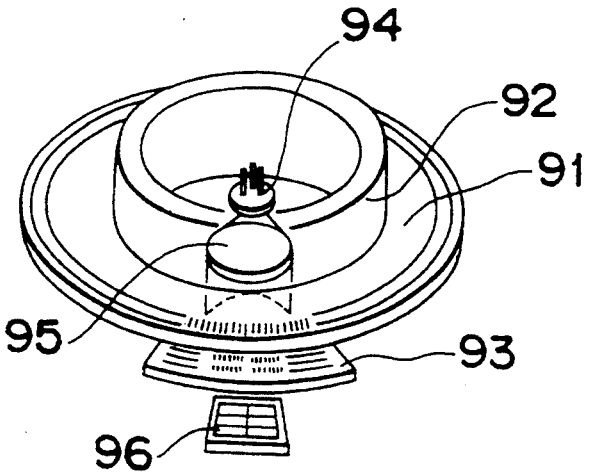
FIG. 4 is a perspective view of a laser type encoder used in the first embodiment.

Although a magnetic encoder or a normal optical encoder may be used for the rotary encoders 23 and 24, a laser type encoder having high resolution and high-speed response and utilizing diffraction/interference of a laser beam is used in the instant embodiment. FIG. 4 shows an example of the laser type encoder. In the drawing, reference numeral 91 denotes a moving slit plate having many slits arranged in a circle, which is rotated by a shaft 92 coupled to the first and second rotary shafts 1 and 2. A fixed slit plate 93 confronting the moving slit plate 91 has slits formed in the configuration of a fan. Light emitted from a laser diode 94 passes through a collimator lens 95 and each slit of both slit plates 91 and 93 and is received by a photodetector 96.

Figure 9:
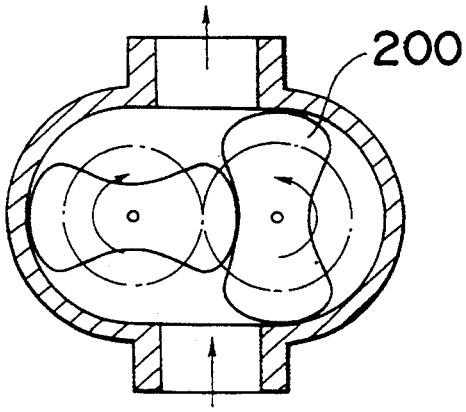
FIGS. 9 through 13 are schematic descriptive views showing modifications of a rotary body to be used in the present invention.
Figure 10:
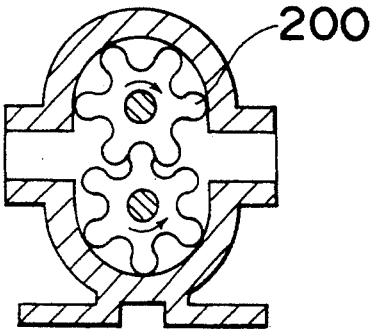
Figure 12:
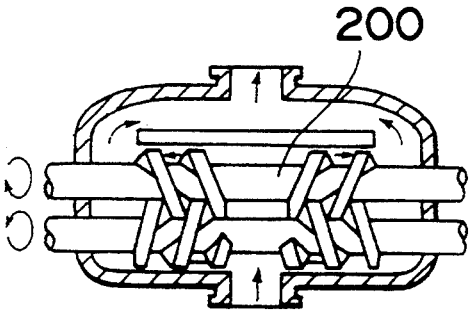
Figure 11A:
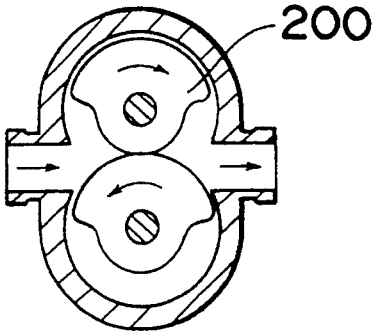
Figure 11B:
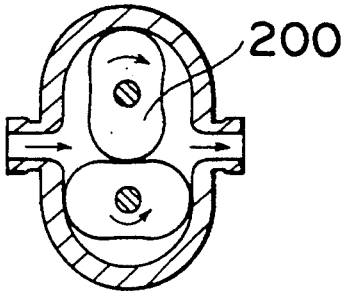
Figure 13:
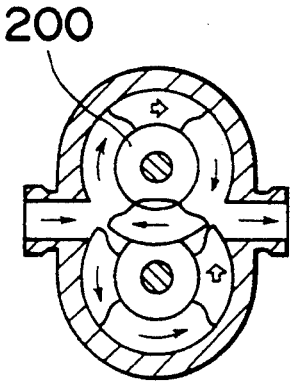

The fluid rotating apparatus of the present invention may be used as a compressor of an air conditioner or the like, and the rotors 200 of the rotary part (corresponding to rotors 6, 7 in FIG. 1) may be of the Roots type as shown in FIG. 9, the gear type as shown in FIG. 10, the single lobe or double lobe type as shown in FIGS. 11A and 11B, respectively, the screw type as shown in FIG. 12, or the outer circumferential piston type as shown in FIG. 13.

Figure 14:
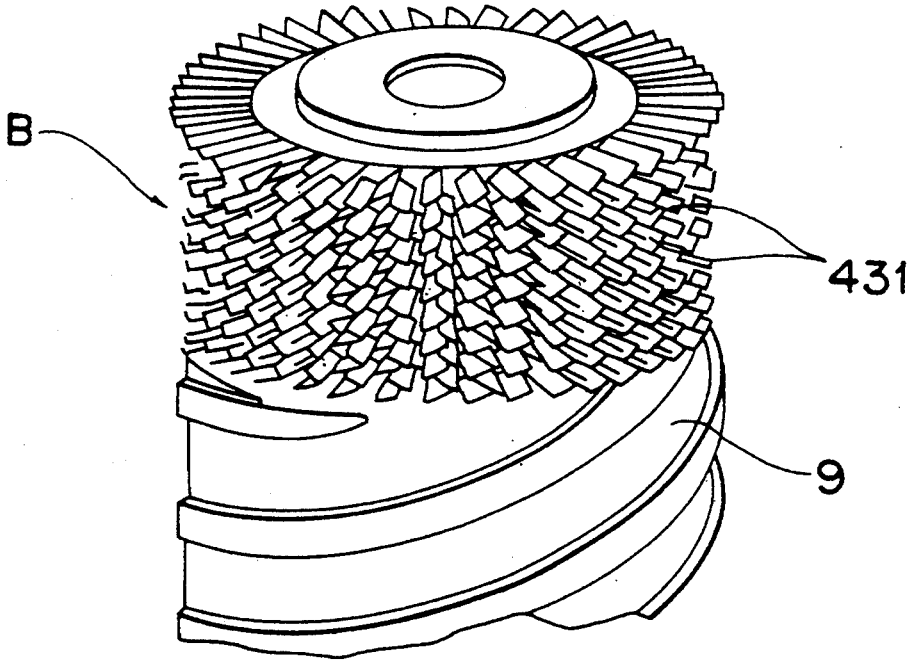
FIG. 14 is a perspective view partly showing a turbine blade and a spiral groove of a vacuum pump according to a modification of the pump in FIG. 1.

FIG. 14 shows a turbine blade 431 and a spiral groove 9 of a vacuum pump according to modification of the pump in FIG. 1. In this modification, the high-vacuum pump structure section B is provided with the turbine blade 431 for impressing momentum to gas molecules, instead of the rotor 10 with the screw grooves 12*a* and 12*b*.

Figure 6:
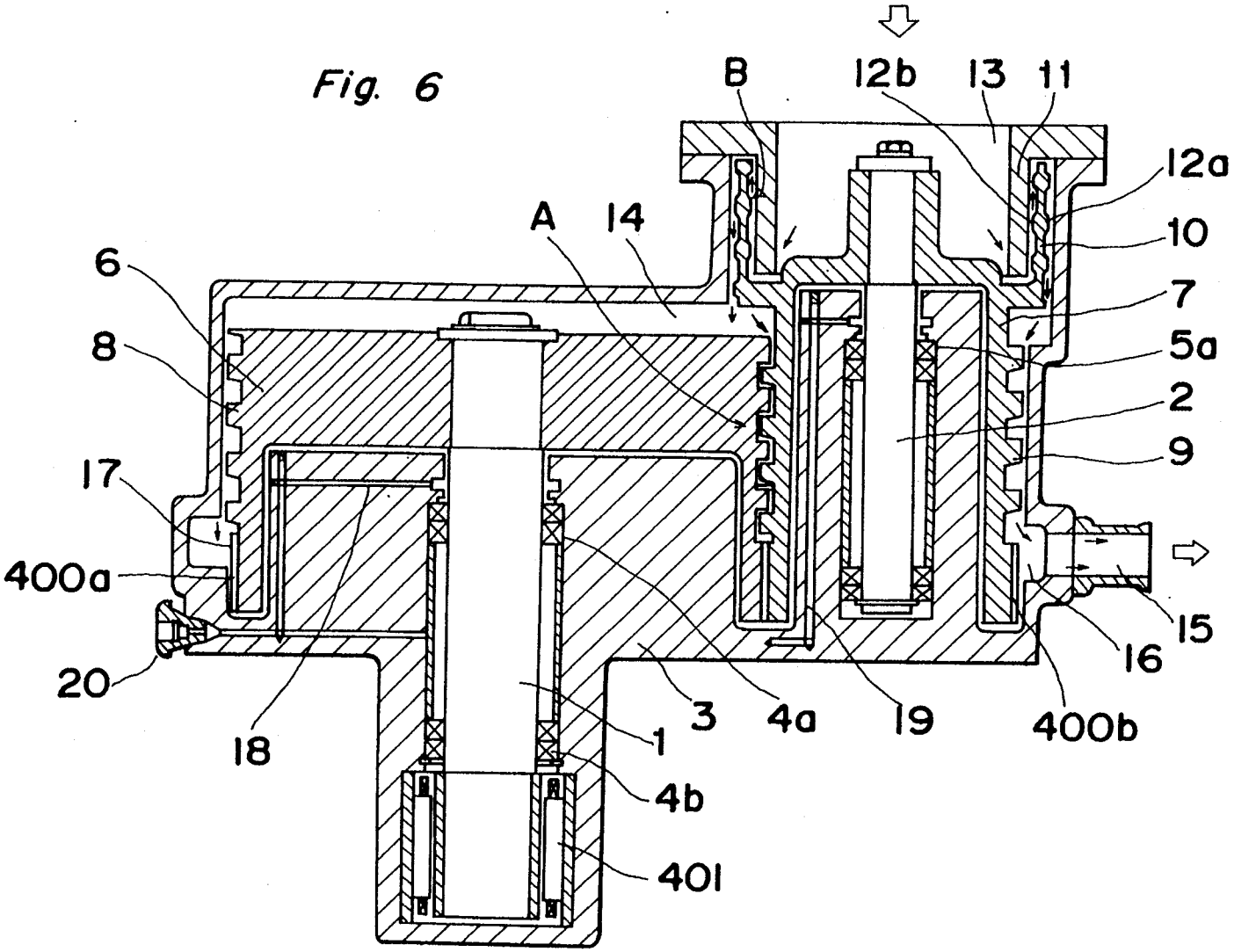
FIG. 6 is a cross-sectional view of a vacuum pump in an embodiment using magnet gears.
Figure 7:
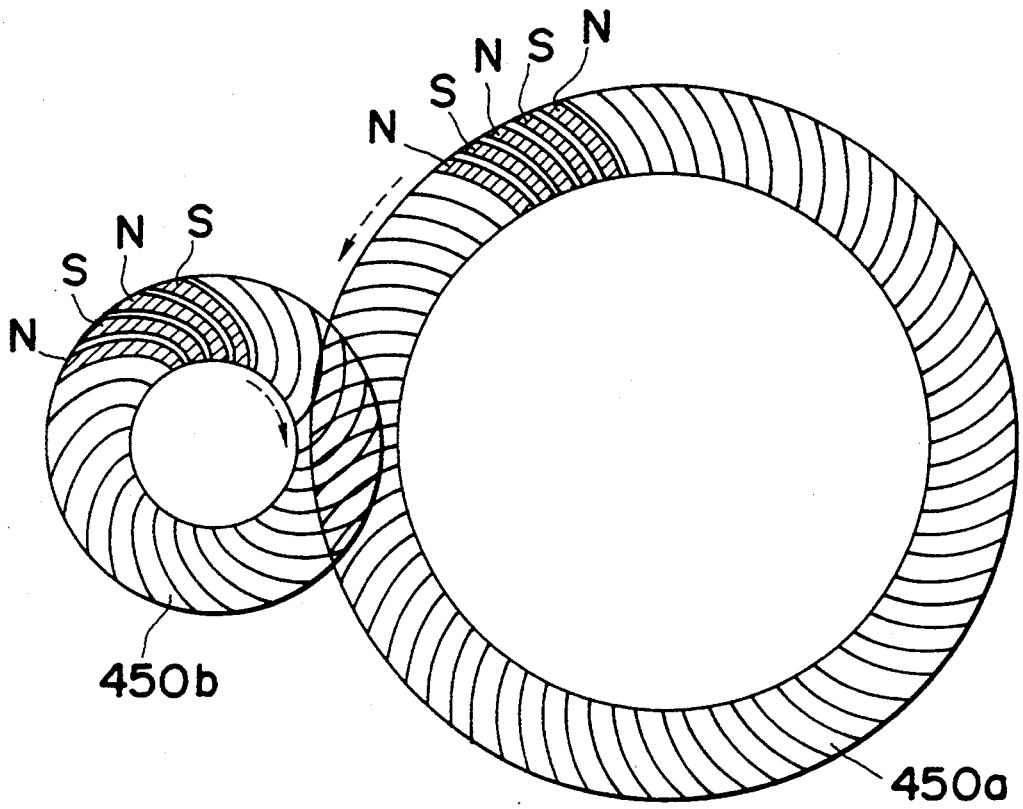
FIG. 7 is a view of magnet gears confronting at faces thereof.
Figure 8A:
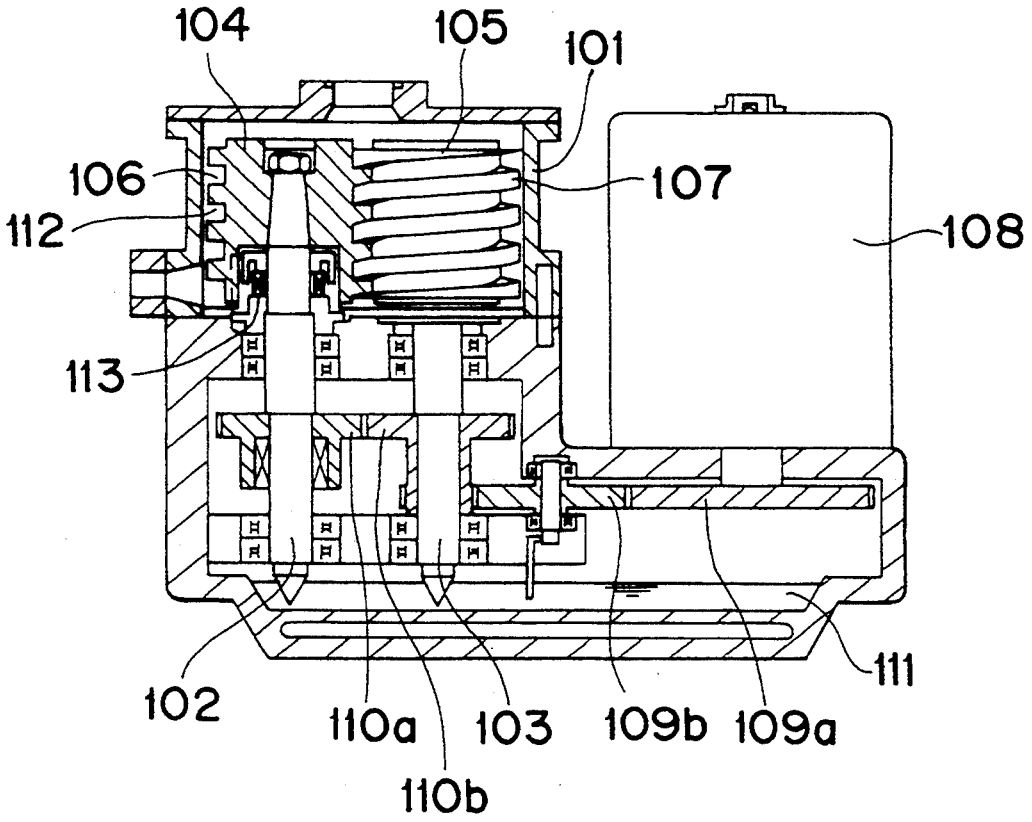
Fig. 8A PRIOR ART
FIG. 8A is a cross-sectional view of a conventional screw pump.
Figure 8B:
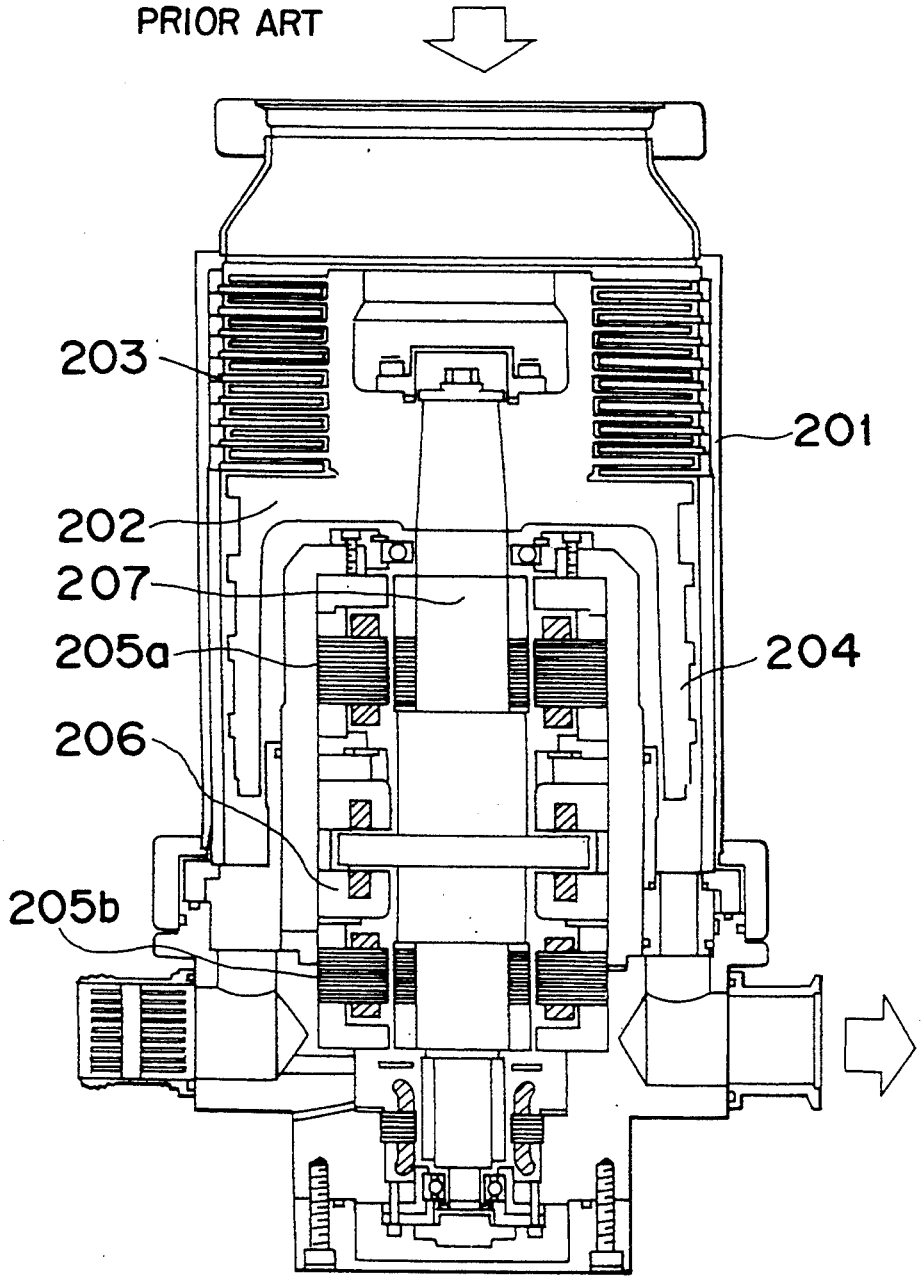
Fig. 8B PRIOR ART
FIG. 8B is a cross-sectional view of a conventional turbo molecular pump.

FIG. 6 shows an embodiment whereby the two rotors are synchronously controlled in a combination of one motor and magnet gears, rather than electronically by means of two motors. There are magnets 400*a* and 400*b* mounted to the rotor 6 of large diameter and the rotor 7 of small diameter, respectively. In the illustrated arrangement, it is sufficient for the driving source of the rotors 400*a* and 400*b* to be one motor 401 provided on the side of the rotor of large diameter, thereby dispensing with the encoder. Further, the magnet gears may confront one another at the surfaces thereof as represented by 450*a* and 450*b* in FIG. 7, not in the peripheries thereof as shown in FIG. 6. In FIG. 7, the magnet gear 450*a* is provided for the rotor of large diameter and the magnet gear 450*b* is for the rotor of small diameter.

As described above, in the case where the pumping amount is small and a small load is imposed on the rotor shaft, it is possible to use transmission means, for instance, magnet gears, fluid clutches or the like, driven synchronously in a contactless manner.

According to the fluid rotating apparatus of the present invention, the synchronous control of rotation is achieved electronically as, e.g., in the already-proposed vacuum pump (U.S. Pat. No. 5,197,861, Teruo MARUYAMA et al.). Therefore, if the present invention is applied to a positive displacement vacuum pump, no timing gears and accompanying mechanical sliding motion are required, unlike the conventional screw pump, etc. Moreover, individual rotors are driven by independent motors, and therefore no power transmission by means of gears is necessitated. For example, in the case of the positive displacement pump or compressor, since it is necessary to obtain a space the volume of which is changed in accordance with the relative movement of two or more rotors, the two or more rotors are synchronously rotated conventionally by a complicated transmission mechanism using transmission gears and timing gears, or a link or cam mechanism. Although it is possible to speed up the machine by supplying a lubricating oil to the section of timing gears and transmission mechanism, in taking the vibration, noise, and reliability of the machine into consideration, the upper limit of the rotational frequency is 10000 rpm at the most. On the other hand, the present invention requires no such complicated mechanism as mentioned above which accompanies mechanical sliding motion, so that the rotary section of the rotors can be driven at high speeds, i.e., 10000 rpm or higher, and the apparatus is simplified because of the omission of the transmission mechanism. Moreover, since an oil seal is not necessary, the torque loss resulting from the mechanical sliding is not brought about, and the regular replacement of the oil seal and oil can be dispensed with. As the power of the vacuum pump is a product of the torque and the rotational frequency, the torque can be made small if the rotational frequency is increased. Accordingly, the reduction in torque because of the speed-up is effective to allow the motors to be compact in size. Further, since the individual rotors are driven by independent motors in the present invention, the necessary torque for each motor is further decreased. If each motor is built in the rotor, the whole apparatus is made considerably compact, lightweight, and space-saving.

Since the kinetic vacuum pump is provided at least above one shaft of the rotors coaxially, it realizes a complex broad-band vacuum pump which is capable of creating a high vacuum ($10^{-8}$ torr or lower) from atmospheric pressure all at once.

The foregoing features belong to the already-proposed vacuum pump, and the present invention affords additional effects as follows.

a) A large pumping speed and a high vacuum can be achieved in the high vacuum region while the pumping efficiency in the lower vacuum region is sufficiently maintained when the apparatus is formed as a broad-band pump;

b) A control system is realized to sufficiently safeguard against disturbances to the synchronous control or for the synchronous control in the transient time when the apparatus is started.

The reason for the above a) will be discussed with reference to the above embodiment (FIG. 6).

In the embodiment of FIG. 6, a screw-type positive displacement pump as an example is constituted of a combination of a plurality of rotors of different outer diameter, with a high-vacuum pump, for example, a screw groove-type vacuum pump being formed above the rotor of small diameter coaxially. The shaft of the rotor of small diameter is easy to drive at high speeds during the synchronous rotation for the reasons described below.

1) Since the mechanical natural frequency can be set high, the dangerous (critical) speed of the system is not exceeded even with the high rotational frequency;

2) Since the absolute values of the load torque and the torque change can be rendered small, disturbances to the synchronous rotation can be limited.

In consequence, the performance (pumping pressure, ultimate vacuum pressure) of the high-vacuum pump provided coaxially above the rotor shaft can be improved when the present invention is used as a broad-band pump. Further, the outer diameter of the high-vacuum pump can be made small while maintaining the performance thereof.

The above effect a) is based on the above mechanical reason, while the effect b) comes from the above electric reason. The effects a) and b) are indivisible. That is, as the diameter of the rotor becomes small, the inertial load of the motor is reduced, thereby making it possible to obtain a stable synchronous control system resistant to disturbances and having high response characteristics.

It is needless to say that the present invention can be used as a clean and compact roughing pump even without the kinetic pump (structural section B in FIG. 1). Even in such case as above, the effect b) is naturally obtained. Besides, since one of the two rotors becomes smaller in outer diameter, the total structure of the pump is made lighter in weight and more compact in size.

In addition, the two rotors may be synchronously rotated not by the electronic control with use of two motors, an encoder, and a controller, but by means of a contactless transmission means, e.g., magnet gears, because the load torque of the rotor of small diameter becomes smaller in proportion to the outer diameter thereof, and even a magnetic of a relatively small limit of the transmission driving torque can transmit the torque.

If the rotor is provided with a threaded groove (including a screw groove) in the outer periphery thereof in the positive displacement vacuum pump structure section A, a Roots type vacuum pump performs one discharge in one rotation, and the operating fluid includes large pulsations. In contrast, the screw groove type pump forms approximately a continuous flow, thereby decreasing the change of the torque impressed to the motor of each shaft. Although the torque change leads to the disturbance of the synchronous rotation of the rotary shafts, as the screw groove type pump is employed, the rotors of the screw groove type can be synchronously driven at higher speeds and with higher accuracy. In the case of the screw type pump, the suction side and the discharge side are sealed by the recessed parts and projecting parts in many stages are meshed with each other, thus reducing adverse influences due to internal leakage and increasing the speed to reach the desired vacuum. Different from the rotors of the gear and rotors of the Roots type, that is, rotors of abnormal shape, rotors of the screw type have a cross section perpendicular to the central axis of rotation thereof in a form relatively close to a circle, so that a cavity is formed up to the vicinity of the outer peripheral part to secure a large inner space. The space may be utilized for the bearing part as in the present embodiment, which miniaturizes the apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid rotating apparatus comprising:

a housing;

a pair of rotary shafts rotatably mounted in said housing;

a pair of interengaging rotors accommodated in said housing and respectively mounted on said pair of rotary shafts, one of said rotors having its outer diameter different from that of the other of said rotors;

bearings for supporting said rotary shafts;

a fluid suction port formed in said housing for providing fluid to said interengaging rotors; a fluid discharge port formed in said housing for discharging fluid which has been pumped by said interengaging rotors;

rotating means mounted to said housing for rotating said rotors such that a ratio of rotational frequencies of said rotors is inverse to a ratio of the outer diameters of said rotors, respectively;

control means, provided for each of said rotary shafts, for synchronously controlling said rotors such that said rotors rotate without contacting one another;

wherein said one of said rotors having its outer diameter different than the other of said rotors comprises a first rotor, and said first rotor has its outer diameter smaller than the other of said rotors; and wherein a high-vacuum pump structure section is mounted coaxially of the one to said shafts on which said first rotor is mounted, said high-vacuum pump structure section being operable to pump fluid from said suction port to said interengaging rotors.

2. The fluid rotating apparatus as claimed in claim 1, wherein said control means comprises magnet gears arranged on said rotors, respectively.

3. The fluid rotating apparatus as claimed in claim 1, wherein said high vacuum pump structure section is provided with a turbine blade for providing momentum to gas molecules.

4. The fluid rotating apparatus as claimed in claim 1, wherein each of said pair of rotors is provided with a screw groove or a spiral groove in its outer periphery.

5. The fluid rotating apparatus as claimed in claim 1, wherein said rotating means comprises a motor operatively coupled with one of said rotary shafts.

6. The fluid rotating apparatus as claimed in claim 1, wherein said rotating means comprises a pair of motors operatively coupled with said pair of rotary shafts, respectively.

7. A fluid rotating apparatus comprising:

a housing;

a pair of rotary shafts rotatably mounted in said housing;

a pair of interengaging rotors accommodated in said housing and respectively mounted on said pair of rotary shafts, one of said rotors having its outer diameter different from that of the other of said rotors;

bearings for supporting said rotary shafts;

a fluid suction port formed in said housing for providing fluid to said interengaging rotors; a fluid discharge port formed in said housing for discharging fluid which has been pumped by said interengaging rotors;

a pair of motors mounted to said housing for respectively rotating said pair of rotors independently such that a ratio of rotational frequencies of said rotors is inverse to a ratio of the outer diameters of said rotors, respectively;

a detecting means mounted to said housing for detecting rotating angles and rotating frequencies of said motors;

control means for synchronously controlling said motors based on signals output by said detecting means, whereby the fluid is drawn and discharged in accordance with a change in volume of a space defined by said rotors and said housing;

wherein said one of said rotors having its outer diameter different than the other of said rotors comprises a first rotor, and said first rotor has its outer diameter smaller than the other of said rotors; and wherein a high-vacuum pump structure section is mounted coaxially to the one of said shafts on which said first rotor is mounted, said high-vacuum pump structure section being operable to pump fluid from said suction port to said interengaging rotors.

8. The fluid rotating apparatus as claimed in claim 7, wherein said high vacuum pump structure section is provided with a turbine blade for providing momentum to gas molecules.

9. The fluid rotating apparatus as claimed in claim 7, wherein each of said rotors is provided with a screw groove or a spiral groove in its outer periphery.

* * * * *